US006938640B2

(12) United States Patent
Mustoe

(10) Patent No.: US 6,938,640 B2
(45) Date of Patent: Sep. 6, 2005

(54) RECESSED BOX ASSEMBLY FOR A DRYER EXHAUST HOSE

(76) Inventor: Michael S. Mustoe, 9623 E. Clinton St., Scottsdale, AZ (US) 85260

( * ) Notice: Subject to any disclaimer, the term of this patent is extended or adjusted under 35 U.S.C. 154(b) by 393 days.

(21) Appl. No.: 10/308,662

(22) Filed: Dec. 2, 2002

(65) Prior Publication Data

US 2004/0104228 A1 Jun. 3, 2004

(51) Int. Cl.[7] ..... F16L 5/00
(52) U.S. Cl. ..... 137/360; 220/3.6
(58) Field of Search ..... 220/3.2–3.7; 137/360

(56) References Cited

U.S. PATENT DOCUMENTS

| | | | | |
|---|---|---|---|---|
| 3,148,696 A | * | 9/1964 | Hoke | 137/318 |
| 3,468,334 A | | 9/1969 | Hamrick | |
| 3,495,276 A | | 2/1970 | Suess | |
| 3,718,154 A | * | 2/1973 | Doumany | 137/360 |
| 3,831,624 A | * | 8/1974 | Doumany | 137/360 |
| 3,847,175 A | | 11/1974 | Anderson | |
| 4,410,004 A | | 10/1983 | Kifer et al. | |
| 4,688,747 A | | 8/1987 | Helmsdorfer et al. | |
| 4,716,925 A | * | 1/1988 | Prather | 137/360 |
| 5,144,777 A | | 9/1992 | Fishel et al. | |
| 5,287,665 A | | 2/1994 | Rath, Jr. | |
| 5,476,183 A | | 12/1995 | Harpenau | |
| 5,494,244 A | * | 2/1996 | Walton | 248/27.1 |
| 5,590,477 A | | 1/1997 | Carfagno, Sr. | |
| 6,129,109 A | * | 10/2000 | Humber | 137/360 |
| 6,148,850 A | | 11/2000 | Kopp et al. | |
| 6,155,286 A | | 12/2000 | Geary | |
| 6,173,542 B1 | | 1/2001 | Wright | |
| 6,378,227 B1 | | 4/2002 | Bradford | |
| 6,419,102 B1 | | 7/2002 | Harpenau | |
| 6,550,157 B1 | | 4/2003 | Harding | |
| 6,581,627 B2 | * | 6/2003 | Dillon | 137/360 |

* cited by examiner

*Primary Examiner*—Joseph Man-Fu Moy
(74) *Attorney, Agent, or Firm*—Charlene R. Jacobsen; Jordan M. Meschkow; Meschkow & Gresham, P.L.C.

(57) ABSTRACT

A recessed box assembly (20) for a dryer exhaust hose (72) includes a box portion (22), having walls defining a box interior (26) open at a front, and a frame (24) attachable to the box portion (22). The box portion (22) has a port (42) in one of the walls configured to allow a dryer exhaust vent duct (40) to pass into the box interior (26) for interconnection with the dryer exhaust hose (72). Tabs (44) extend from the planar walls into the box interior (26) and releasably engage with receptacle sections (46) on the frame (24).

19 Claims, 3 Drawing Sheets

RECESSED BOX ASSEMBLY FOR A DRYER EXHAUST HOSE

TECHNICAL FIELD OF THE INVENTION

The present invention relates to the field of clothes dryer exhaust systems. More specifically, the present invention relates to a recessed box assembly for a dryer exhaust hose.

BACKGROUND OF THE INVENTION

Clothes dryers exhaust hot air and lint from a vent that is typically located in a lower rear portion of the clothes dryer. The hot air and lint is routed from the dryer vent to the outside of a home or other building via a flexible and/or non-flexible conduit. This conduit then runs through an opening in the building and is terminated external to the building with an exhaust vent adapter.

In a typical configuration, a non-flexible dryer exhaust vent duct is routed within a wall cavity to the outside of the home. The dryer exhaust vent is angled so that it protrudes perpendicularly from a wall surface on the interior of the home. A flexible dryer exhaust hose leading from the dryer vent is then coupled to the exhaust vent duct. As such, this flexible dryer exhaust hose resides between the dryer and the wall surface.

The perpendicular positioning of the dryer exhaust vent duct from the wall surface typically requires the flexible hose to bend in at least two places to compensate for the locations of the dryer vent on the rear of the dryer and the dryer exhaust vent duct within a wall cavity. During installation, this connection is initially made and the dryer is then pushed toward the wall. The flexible dryer exhaust hose is easily kinked, crushed between the wall and the rear of the dryer, or otherwise damaged when pushing the dryer to the wall.

Damage to the flexible hose can cause a restriction in air flow from the dryer resulting in inefficient operation of the dryer. That is, it can take longer periods of time for the clothing to dry. Longer drying periods results in undesirable wear on the clothes due to long tumbling time and higher electricity expenditures. More critically, however, lint can clog the hose in the restricted area. Lint is highly combustible and restricted airflow causes overheating of the exhaust environment, which can result in fire.

To avoid damaging or altering the hose during installation, the dryer is often positioned a considerable distance from the wall containing the exhaust conduit. For example, in order to accommodate the bends in the flexible hose, a space of about five inches between the dryer and wall is typically needed. This additional distance of the dryer from the wall results in less useable space within the laundry room and is aesthetically displeasing.

Attempts have been made to alleviate the problems associated with the aforementioned flexible dryer exhaust hose. The prior art discloses recessed rectangular boxes that are mounted in a wall. In particular, flanges around the perimeter of the boxes are fastened to wall studs. Wallboard is then installed over the wall studs and the flanges, and an opening is made in the wallboard in the area of the box. Some prior art recessed boxes further include a shoulder extending outwardly from the periphery of the box. The shoulder abuts the inner edges of the wall surface at the opening. The non-flexible dryer exhaust vent duct extends into an interior space of the box and the flexible hose is coupled to the vent duct within the interior of the box.

Unfortunately, the use of these prior art recessed boxes requires additional finish work to be performed to the wall surface following installation. The finish work can entail caulking and/or the installation of trim board about the periphery of the opening. Performing finish work is time consuming, thus leading to undesirably high installation costs.

In addition, the shoulder of some prior art recessed boxes, configured to abut the inner surface of the wall surfaces, is of a finite height. Consequently, the shoulder cannot accommodate wall surfaces of varying thickness, such as wallboard, plasterboard, wood paneling, and so forth. Thus, in some applications the shoulder may jut too far forward from the wall surface, or may not protrude far enough to abut the entire thickness of the inner edge. An ill fit leads to an unprofessional appearing installation.

Further problems arise when performing remodeling work at a later date. In particular, the installed box, trim molding, and so forth are difficult to work around when the wall surface is to be painted, wall papered, textured, and so forth. For example, products such as paint, wall paper glue, and texture material may get on the box, trim board, or caulk, thus slowing down progress due to the additional time required for preparation, such as masking, and for clean up. Similarly, special care must be taken when measuring, cutting, and aligning wall paper on the wall surface around the recessed box. Again, the special care hampers progress, which is time consuming, thus, frustrating for the homeowner performing such work, or resulting in higher labor costs when an outside company is hired to perform such work.

SUMMARY OF THE INVENTION

Accordingly, it is an advantage of the present invention that an improved recessed box assembly for a dryer exhaust hose is provided.

It is another advantage of the present invention that a recessed box assembly is provided that enables close placement of a clothes dryer to a wall surface.

Yet another advantage of the present invention is that a recessed box assembly is provided that is cost effectively installed, while yielding an aesthetically pleasing appearance.

The above and other advantages of the present invention are carried out in one form by a recessed box assembly for a dryer exhaust hose. The assembly includes a box portion having planar walls defining a box interior open at a front thereof. The box portion has a port in one of the planar walls configured to allow a dryer exhaust vent duct to pass through the port into the box interior for interconnection with the dryer exhaust hose. The planar walls include a back wall, a top wall, a bottom wall opposing the top wall, and a pair of opposing side walls, each extending perpendicular to and between the top and bottom walls. At least one of the top, bottom, and side walls has a tab extending into the box interior. The assembly further includes a removable frame attachable to the box portion. The frame has first and second opposing sides, and third and fourth opposing sides, each of the third and fourth sides extending perpendicular to and between the first and second opposing sides. The frame further has a receptacle section positioned on an outer surface of at least one of the first, second, third, and fourth sides. The receptacle section is configured to releasably engage with the tab to attach the frame to the box portion.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
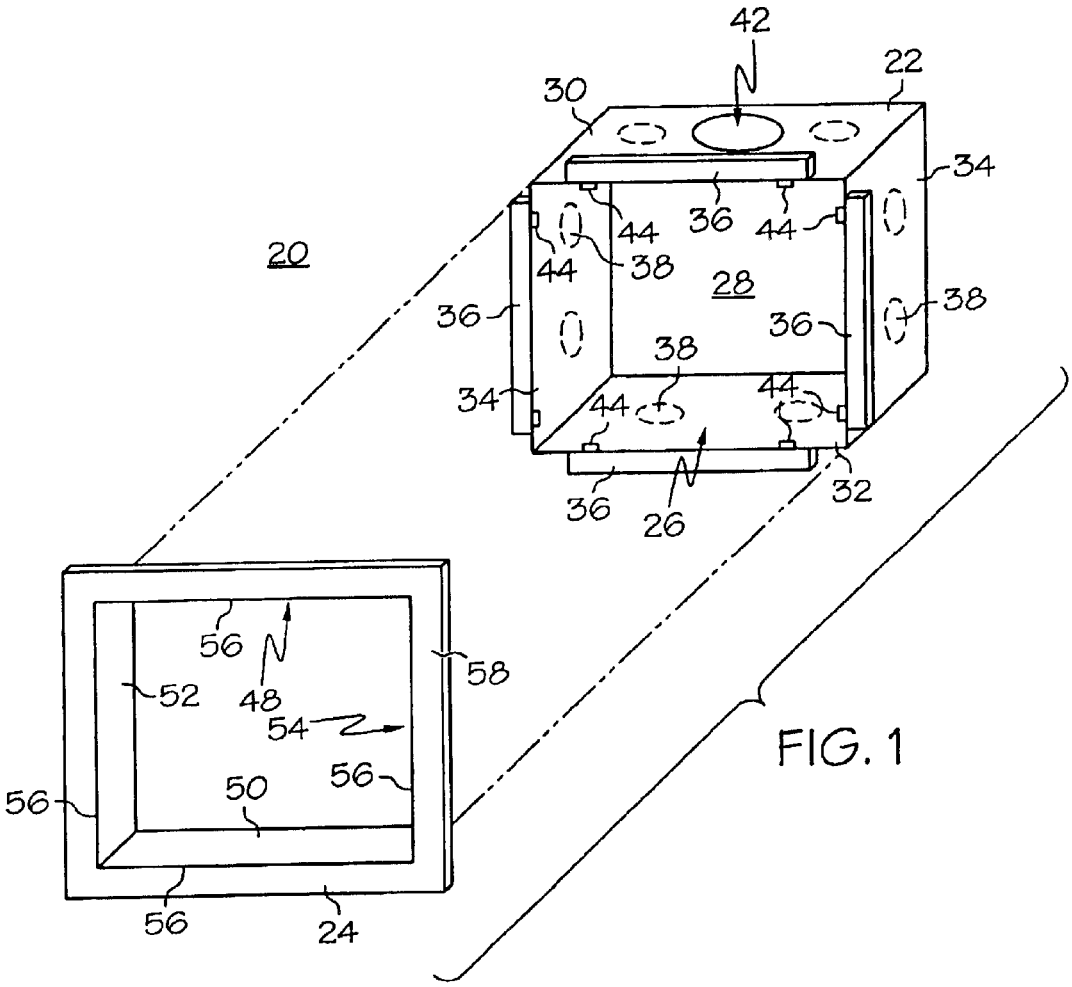
FIG. 1 shows an exploded perspective view of a recessed box assembly in accordance with a preferred embodiment of the present invention.

FIG. 1 shows an exploded perspective view of a recessed box assembly 20 in accordance with a preferred embodiment of the present invention. Recessed box assembly includes a box portion 22 and a removable frame 24 attachable to box portion 22. Box portion 22 and frame 24 of box assembly 20 may be fabricated from a variety of materials including injection-molded, high tensile strength plastics, metal, fiberglass, ceramic materials, and so forth.

Box portion 22 has planar walls that define a box interior 26 open at a front. In particular, the planar walls of box portion 22 include a back wall 28, a top wall 30, and a bottom wall 32 opposing top wall 30. A pair of opposing side walls 34 extend perpendicular to and between top and bottom walls 30 and 32, respectively. The terms "top", "bottom", and "side" in connection with the planar walls of box portion 26 are used to distinguish the planar walls of box portion 22 for clarity of illustration. However, top wall 30, bottom wall 32, and side walls 34 are of substantially equivalent lengths so that box portion 22 may be advantageously oriented in any of a number of desired positions. Accordingly, in any given installation, that which is coined "top wall" herein may be a bottom wall or side wall. Similarly, that which is coined "side wall" herein may be a top wall or bottom wall, while that which is coined "bottom wall" herein may be a top wall or side wall. As such, box portion 22 is adaptable for enabling venting in any of four lateral directions (i.e., top, bottom, right side, or left side).

Flanges 36 extend from at least one of top wall 30, bottom wall 32, and side walls 34 for fastening to wall studs, discussed below. In a preferred embodiment, flanges 36 extend from each of top, bottom, and side walls 30, 32, and 34, respectively, so that box portion 22 can be installed in any of a number of orientations, discussed below.

Box portion 22 includes knockouts 38 desirably located in back wall 28, top wall 30, bottom wall 32, and side walls 34. Knockouts 38 may be readily removed by punching, hammering, or cutting to enable passage of a conduits, for example, a gas pipe (not shown) for a gas heated dryer into box interior 26. In addition, box portion 22 includes a port 42, shown in top wall 30, for allowing dryer exhaust vent duct 40 to pass into box interior 26.

Box portion 22 further includes tabs 44 extending from at least one of top wall 30, bottom wall 32, and side walls 34 and into box interior 26. Tabs 44 are configured to engage with receptacle sections 46 (see FIG. 2) on frame 24. In a preferred embodiment, tabs 44 extend from each of top, bottom, and side walls 30, 32, and 34, respectively, into box interior 26 to facilitate an interconnection of box portion 22 with removable frame 24 in a desired orientation.

Removable frame 24 includes a first side 48 and a second side 50 opposing first side 48. In addition, frame 24 includes a third side 52 and a fourth side 54 opposing third side 52. Third and fourth sides 52 and 54, respectively, extend perpendicular to and between first and second sides 48 and 50, respectively.

Figure 2:
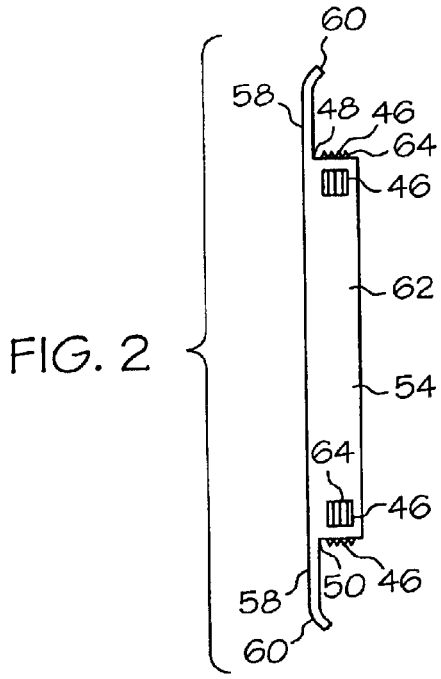
FIG. 2 shows a side view of a frame of the box assembly of FIG. 1.

Referring to FIG. 2 in connection with FIG. 1, FIG. 2 shows a side view of frame 24 of box assembly 20. First, second, third, and fourth sides 48, 50, 52, and 54 have forward facing edges 56 substantially aligned in a single plane and collectively defining a frame periphery. An outer trim element 58 extends perpendicularly from first, second, third, and fourth sides 48, 50, 52, and 54, respectively, and forms a single contiguous element about the frame periphery. Outer trim element 58 has an inside return portion 60 along an outer edge of element 58.

Receptacle sections 46 are positioned on an outer surface 62 of at least one of first, second, third, and fourth sides 48, 50, 52, and 54. In a preferred embodiment, receptacle sections 46 extend from outer surface 62 of each of first, second, third, and fourth sides 48, 50, 52, and 54, respectively, to facilitate releasable engagement with tabs 44 on box portion 22 in a desired orientation.

Receptacle sections 46 are generally configured as a ridges 64. When frame 24 is mounted onto box portion 22, first, second, third, and fourth sides 48, 50, 52, and 54 of frame 24 slide into box interior 26 so that ridges 64 slide against tabs 44. Thus, ridges 64 provide frictional engagement with tabs 44 for ready installation and removal of frame 24 onto box portion 22 as desired.

Figure 3:
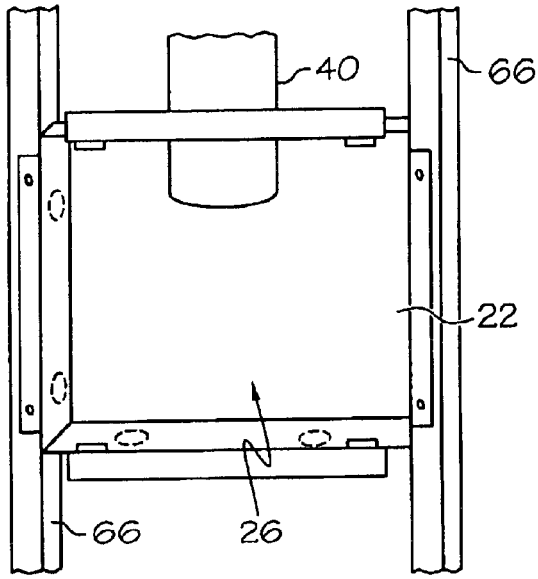
FIG. 3 shows a perspective view of a box portion of the box assembly of FIG. 1 installed between wall studs.
Figure 4:
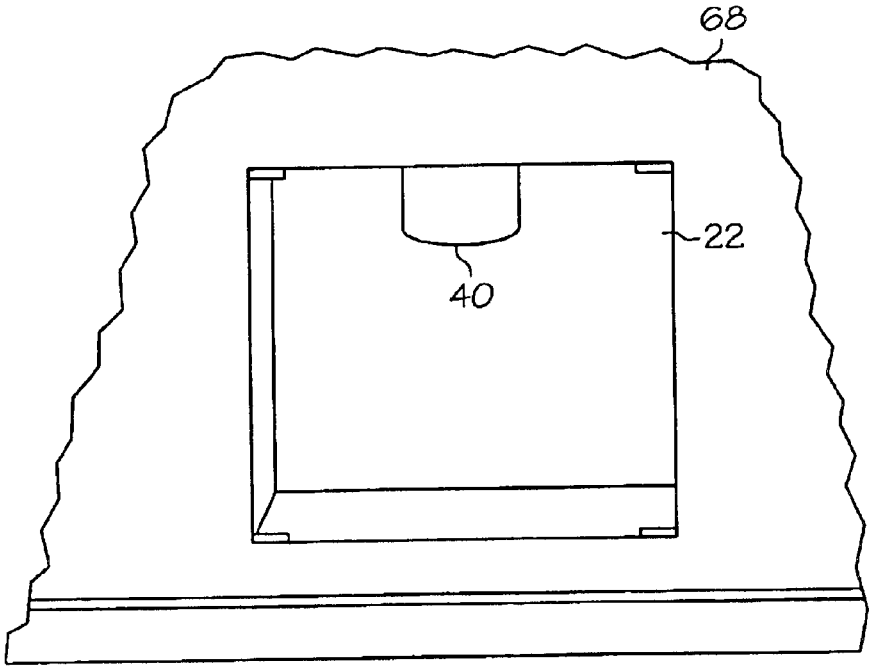
FIG. 4 shows a perspective view of a finish layer installed over the box portion and wall studs of FIG. 3.
Figure 5:
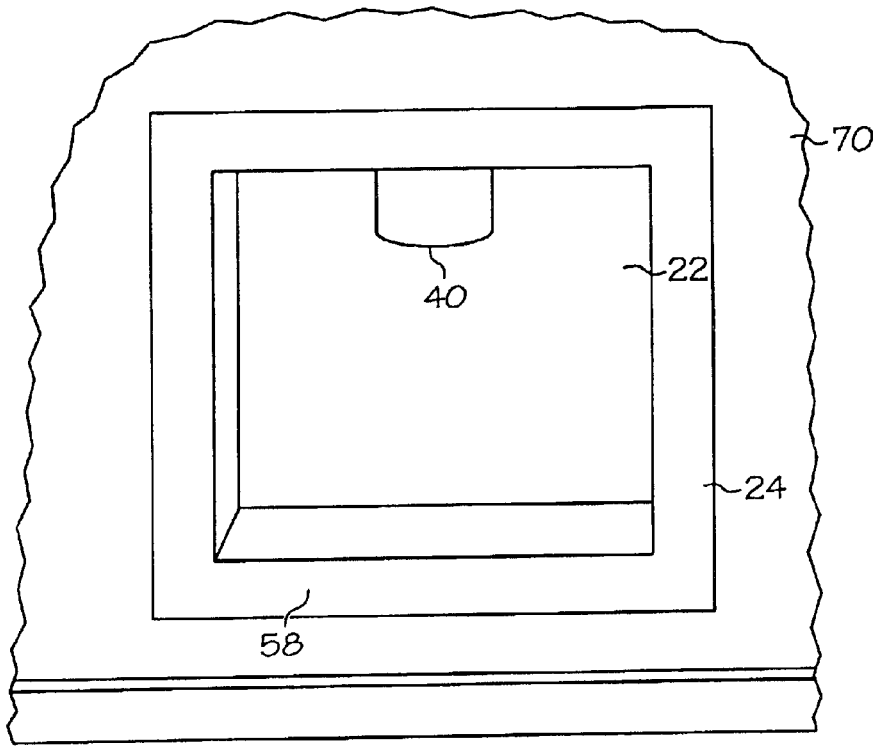
FIG. 5 shows a perspective view of the frame of FIG. 2 installed onto the box portion installed in a wall.

Referring to FIGS. 3–5, FIG. 3 shows a perspective view of box portion 22 of box assembly 20 (FIG. 1) installed between wall studs 66. FIG. 4 shows a perspective view of a finish layer 68 installed over box portion 22 and wall studs 66, and FIG. 5 shows a perspective view of frame 24 of box assembly 20 attached to box portion 22 installed in a wall 70. Accordingly, FIGS. 3–5 show the progression of an installation of recessed box assembly 20. As shown in FIGS. 3–5, box portion 22 is oriented such that port 42 (FIG. 1) faces upwardly to accommodate the vertically rising dryer exhaust vent duct 40. However, box portion 22 may be reoriented in the appropriate direction if duct 40 is horizontally oriented.

Box portion 22 is sized such that flanges 36 rest against and can be fastened to wall studs 66. For example, box portion 22 of top, bottom, and side walls 30, 32, and 34 has exterior dimensions that are less than sixteen inches in height and width so that box portion can fit between wall studs 66 on sixteen inch centers. For example, with box portion 22 having outside dimensions of approximately fourteen inches, flanges 36 can be made to extend far enough to fasten onto wall studs 66 on twenty-four inch centers. In an alternative preferred embodiment, separately attachable tabs can be coupled to and extend from flanges 36 to be subsequently attached to wall studs on twenty-four inch centers.

Alternatively, a fourteen inch outside dimension box portion 22 may have flanges 36 that can accommodate wall stud spacings of up to twenty-four inch centers with lengthwise joints every one or two inches. Accordingly, flanges 36 can be cut or snapped at the joints to remove a portion of flanges 36 in order to accommodate wall stud spacings that are between sixteen and twenty-four inches. In yet another alternative embodiment, box portion 22 of top, bottom, and side walls 30, 32, and 34 may exhibit outside dimensions that are approximately twenty-two inches to fit within twenty-four inch wall spacings.

As shown, when box portion 22 is mounted between wall studs 66, dryer exhaust vent duct 40 directed between walls studs 66 is passed through port 42 (FIG. 1) into box interior 26. Box portion 22 is configured for mounting below finish layer 68 of wall 70. As such, following attachment of box portion 22 to wall studs 66, finish layer 68 is hung over wall studs 66 and box portion 22, thus covering flanges 36. Finish layer 68 may be drywall material, wood paneling, and the like, which is coupled by nailing, stapling, and/or gluing finish layer 69 to wall studs 66 in a conventional manner. Finish layer 68 may have a pre-cut opening sized to match the open front of box portion 22.

Once finish layer 68 is hung, finish layer 68 may be textured, painted, wall-papered or otherwise finished as desired by the homeowner to create the finished appearance of wall 70. Once work is completed on wall 70, frame 24 is simply snapped onto box portion 22 such that ridges 64 of frame 24 engage tabs 44 of box portion 24. Thereafter, should any remodeling work be required, frame 24 can be snapped off of box portion 22 for repainting, wall-papering, and so forth.

The snap-on fit of frame 24 removes the need for caulking around box portion 22 and/or hanging trim molding on the finish layer surrounding box portion 22, thus simplifying the installation of recessed box assembly 20 relative to prior art devices. Furthermore, the width of ridges 64 (FIG. 2) accommodates various widths of finish layer 68 so that first, second, third, and fourth sides 48, 50, 52, and 54, respectively (FIG. 1), can be held at varying depths within box interior 26. Accordingly, when frame 24 snaps onto box portion 22, outer trim element 58 of frame 24 fits generally flush against wall 70, regardless of the thickness of finish layer 68.

Figure 6:
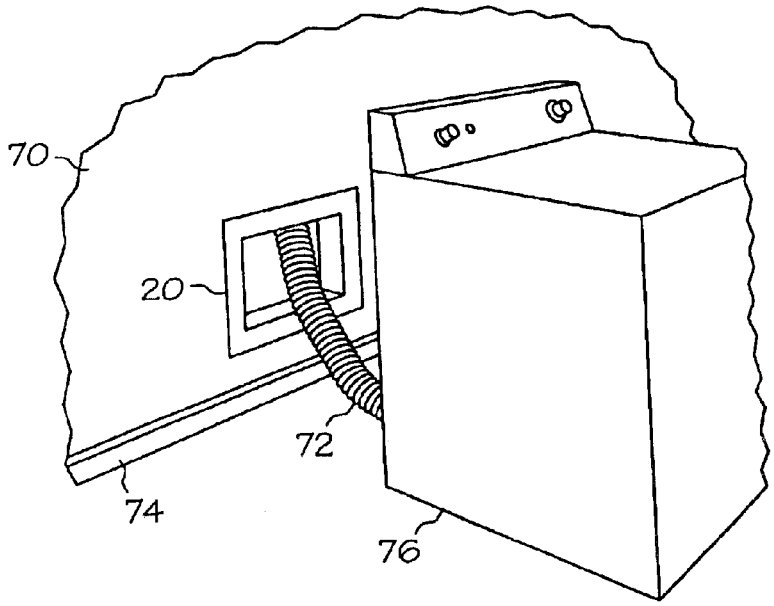
FIG. 6 shows a perspective view of the recessed box assembly installed in a finished wall with a dryer exhaust hose installed therein.

FIG. 6 shows a perspective view of recessed box assembly 20 installed in wall 70 with a dryer exhaust hose 72 installed therein. As shown, frame 24 of assembly 20 resides against wall 70 above a baseboard 74. Although, assembly 20 is shown as being mounted above baseboard 74, it should be apparent that an assembly 20 such that a bottom edge of frame 24 contacts the floor, thereby eliminating the need for baseboard 74 at that location.

FIG. 6 further shows a clothes dryer 76 from which dryer exhaust hose 72 extends. During installation, hose 72 is coupled to dryer exhaust duct 40 (FIG. 3) within box interior 26. Thereafter, dryer 76 is pushed toward wall 70. Recessed box assembly 20 enables the interconnection of hose 72 with dryer exhaust duct 40 (FIG. 5) within the wall cavity instead of external to the wall surface. Accordingly, dryer 76 can be placed in relatively close proximity to wall 70 with reduced probability of kinking, bending, or otherwise damaging hose 72.

In summary, the present invention teaches of an improved recessed box assembly for a dryer exhaust hose. The recessed box assembly enables close placement of a clothes dryer to a wall surface. In addition, the box assembly having substantially equal length sides allows box assembly to adapt to venting in any of four directions. Moreover, installation of a box portion beneath the wallboard, followed by the snap-on fit of a frame after the wallboard is hung, results in a cost effective installation that is aesthetically pleasing in appearance. Furthermore, the frame can be readily removed to perform later finish work to the wall, such as, painting, texturing, and wall-papering.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A recessed box assembly for a dryer exhaust hose, said assembly comprising:

a box portion having planar walls defining a box interior open at a front thereof, said box portion having a port in one of said planar walls configured to allow a dryer exhaust vent duct to pass through said port into said box interior for interconnection with said dryer exhaust hose, said planar walls including:

a back wall;

a top wall;

a bottom wall opposing said top wall; and a pair of opposing side walls, each extending perpendicular to and between said top and bottom walls, wherein at least one of said top, bottom, and side walls has an engagement section projecting toward said box interior; and a removable frame attachable to said box portion, said frame having first and second opposing sides, and third and fourth opposing sides, each of said third and fourth sides extending perpendicular to and between said first and second opposing sides, said frame further having a receptacle section positioned on an outer surface of at least one of said first, second, third, and fourth sides, said receptacle section being configured to releasably engage with said engagement section to attach said frame to said box portion.

2. An assembly as claimed in claim 1 further comprising a flange extending perpendicularly from said at least one of said top wall, said bottom wall, and said pair of side walls for allowing said box portion to be mounted between two wall studs.

3. An assembly as claimed in claim 1 further comprising a flange extending perpendicularly from each of said top wall, said bottom wall, and said pair of side walls for allowing said box portion to be mounted between two wall studs.

4. An assembly as claimed in claim 1 wherein:

said box portion is configured for mounting between wall studs and below a finish layer of a wall; and said first, second, third, and fourth sides of said frame are configured to shoulder said finish layer when said frame is attached to said box portion.

5. An assembly as claimed in claim 1 wherein said box portion includes a plurality of knock-outs located in said planar walls.

6. An assembly as claimed in claim 1 wherein said top wall, said bottom wall, and said pair of side walls are of substantially equivalent lengths.

7. An assembly as claimed in claim 1 wherein said frame further comprises an outer trim element extending perpendicularly from said first, second, third, and fourth sides.

8. An assembly as claimed in claim 7 wherein said first, second, third, and fourth sides have forward facing edges substantially aligned in a single plane collectively defining a frame periphery and said outer trim element is forms a single contiguous element about said frame periphery.

9. An assembly as claimed in claim 7 said frame further comprises an inside return portion along an outer edge of said outer trim element.

10. An assembly as claimed in claim 1 wherein said receptacle section includes a plurality of ridges, said ridges providing frictional engagement with said engagement section.

11. A recessed box assembly for a dryer exhaust hose, said assembly comprising:

a box portion having planar walls defining a box interior open at a front thereof, said box portion having a port in one of said planar walls configured to allow a dryer exhaust vent duct to pass through said port into said box interior for interconnection with said dryer exhaust hose, said box portion being configured for mounting between wall studs and below a finish layer of a wall, and said planar walls including:

a back wall;

a top wall;

a bottom wall opposing said top wall; and a pair of opposing side walls, each extending perpendicular to and between said top and bottom walls, wherein at least one of said top, bottom, and side walls has an engagement section projecting toward said box interior; and a removable frame attachable to said box portion, said frame including:

a first side;

a second side opposing said first side;

a third side;

a fourth side opposing said third side, each of said third and fourth sides extending perpendicular to and between said first and second opposing sides, said first, second, third, and fourth sides of said frame being configured to shoulder said finish layer when said frame is attached to said box portion;

an outer trim element extending perpendicularly from said first, second, third, and fourth sides; and a receptacle section positioned on an outer surface of at least one of said first, second, third, and fourth sides, said receptacle section being configured to releasably engage with said engagement section to attach said frame to said box portion.

12. An assembly as claimed in claim 11 further comprising a flange extending perpendicularly from said at least one of said top wall, said bottom wall, and said pair of side walls for allowing said box portion to be mounted between said wall studs.

13. An assembly as claimed in claim 11 wherein said box portion includes a plurality of knock-outs located in said planar walls.

14. An assembly as claimed in claim 11 wherein said first, second, third, and fourth sides have forward facing edges substantially aligned in a single plane collectively defining a frame periphery and said outer trim element is forms a single contiguous element about said frame periphery.

15. An assembly as claimed in claim 11 wherein said receptacle section includes a plurality of ridges, said ridges providing frictional engagement with said engagement section.

16. A recessed box assembly for a dryer exhaust hose, said assembly comprising:

a box portion having planar walls defining a box interior open at a front thereof, said box portion having a plurality of knock-outs located in said planar walls, and a port for reception in said box interior of a dryer exhaust vent duct for interconnection with said dryer exhaust hose, said planar walls including:

a back wall;

a top wall;

a bottom wall opposing said top wall; and a pair of opposing side walls, each extending perpendicular to and between said top and bottom walls, wherein at least one of said top, bottom, and side walls has an engagement section projecting toward said box interior;

a flange extending perpendicularly from said at least one of said top wall, said bottom wall, and said pair of side walls for allowing said box portion to be mounted between two wall studs; and a removable frame attachable to said box portion, said frame having first and second opposing sides, and third and fourth opposing sides, each of said third and fourth sides extending perpendicular to and between said first and second opposing sides, said frame further having a receptacle section positioned on an outer surface of at least one of said first, second, third, and fourth sides, said receptacle section being configured to releasably engage with said engagement section to attach said frame to said box portion.

17. An assembly as claimed in claim 16 wherein:

said box portion is configured for mounting below a finish layer of a wall; and said first, second, third, and fourth sides of said frame are configured to shoulder said finish layer when said frame is attached to said box portion.

18. An assembly as claimed in claim 16 wherein said frame further comprises an outer trim element extending perpendicularly from said first, second, third, and fourth sides.

19. An assembly as claimed in claim 16 wherein said receptacle section includes a plurality of ridges, said ridges providing frictional engagement with said engagement section.

* * * * *